US008368599B2

(12) United States Patent
Lim et al.

(10) Patent No.: US 8,368,599 B2
(45) Date of Patent: Feb. 5, 2013

(54) SIMPLY FABRICABLE SMALL ZEROTH-ORDER RESONANT ANTENNA WITH EXTENDED BANDWIDTH AND HIGH EFFICIENCY

(75) Inventors: Sungjoon Lim, Gyeonggi-Do (KR); Taehee Jang, Gyeonggi-Do (KR)

(73) Assignee: Chung-Ang University Industry-Academy Cooperation Foundation, Seoul (KR)

( * ) Notice: Subject to any disclaimer, the term of this patent is extended or adjusted under 35 U.S.C. 154(b) by 336 days.

(21) Appl. No.: 12/807,176

(22) Filed: Aug. 30, 2010

(65) Prior Publication Data

US 2011/0050505 A1 Mar. 3, 2011

(30) Foreign Application Priority Data

Sep. 1, 2009 (KR) ..... 10-2009-0081727

(51) Int. Cl.
*H01Q 9/04* (2006.01)
*H01Q 1/38* (2006.01)

(52) U.S. Cl. ..... 343/700 MS; 343/749

(58) Field of Classification Search ..... 343/702, 343/749, 750, 700 MS
See application file for complete search history.

(56) References Cited

U.S. PATENT DOCUMENTS

2008/0143607 A1* 6/2008 Jung et al. ..... 343/700 MS
2010/0214180 A1* 8/2010 Krogerus ..... 343/702
2012/0032862 A1* 2/2012 Ying ..... 343/749

* cited by examiner

*Primary Examiner* — Don Le
(74) *Attorney, Agent, or Firm* — Ladas & Parry LLP

(57) ABSTRACT

Provided is a simply fabricable small zeroth-order resonant antenna with extended bandwidth and high efficiency. The zeroth-order resonant antenna includes a feeding patch, a transmission line, and a pair of ground patches. The feeding patch is disposed on a top surface of a substrate having a mono-layer structure, and is configured to receive a signal from the outside. The transmission line includes a unit cell disposed on the top surface of the substrate and is configured to transmit a signal delivered from the feeding patch. The pair of ground patches is longitudinally disposed on the top surface of the substrate in the same direction as a longitudinal direction of the transmission line around the transmission line. The unit cell includes an upper patch and an inductor unit. The upper patch is disposed on the top surface of the substrate and is configured to receive a signal.

20 Claims, 23 Drawing Sheets

(a)

(b)

(a)

(b)

(c)

(a)

(b)

(a)

(b)

(a)

(b)

(a)

(b)

(a)

(b)

SIMPLY FABRICABLE SMALL ZEROTH-ORDER RESONANT ANTENNA WITH EXTENDED BANDWIDTH AND HIGH EFFICIENCY

CROSS-REFERENCE TO RELATED APPLICATION

This application claims priority to Korean Patent Application No. 10-2009-0081727 filed on Sep. 1, 2009 and all the benefits accruing therefrom under 35 U.S.C. §119, the contents of which are incorporated by reference in their entirety.

BACKGROUND

The present disclosure relates to a simply fabricable small zeroth-order resonant antenna with extended bandwidth and high efficiency, and more particularly to, a zeroth-order resonant antenna applicable to wireless communication devices because its resonant frequency is determined regardless of the size of an antenna and the resonant antenna has extended bandwidth in spite of its small size.

Metamaterials that have been extensively studied in regard to microwave circuits and antennas are artificially synthesized to show special electromagnetic characteristics that are rarely observed in nature. Compared to existing natural materials, the metamaterials have special characteristics such as anti-parallel phase, group velocities, and zero propagation constant, and may be implemented by Split-ring Resonator (SSR) or Composite Right/Left Handed Transmission Line (CRLH TL).

CRLH TL may be applied to a dominant mode leaky-wave antenna that radiates in forward and backward directions by using the characteristics of anti-parallel phase and group velocities. Also, in regard to left-handed material characteristics, a resonator has an infinite wavelength by a zero propagation constant, and the resonant frequency is independent of the size of the resonator. Accordingly, the zero propagation constant characteristics of the resonant antenna enables further miniaturization of the resonant antenna compared to a related-art half-wavelength antenna.

FIG. 1 is a diagram illustrating a related-art zeroth-order resonant (ZOR) antenna. Referring to FIG. 1, the related-art ZOR antenna (hereinafter, referred to as 'prior art 1') may include a plurality of unit cells, each of which has a size of $7.3\times15\ mm^2$. Also, $w_1$ may equal 15.0 mm, and $w_2$ may equal 0.2 mm in FIG. 1. When the antenna of FIG. 1 is configured with two unit cells, the resonant frequency is 3.38 GHz, and the electrical size of the antenna becomes $\lambda_0/6\times\lambda_0/6\times\lambda_0/57$ with respect to the resonant frequency $f_0$. Accordingly, as the ZOR antenna uses a zero propagation constant, the ZOR antenna has an effect of size reduction compared to a related-art antenna. However, since the ZOR antenna according to the prior art 1 shows a bandwidth of 0.1% or less, there is a limit to its application to wireless communication apparatuses.

In recent years, studies have been conducted to solve a bandwidth limitation of ZOR antennas. FIG. 2 is a diagram illustrating a configuration of a metamaterial ring antenna proposed for bandwidth improvement. The ring antenna (hereinafter, referred to as 'prior art 2') of FIG. 2 may be implemented over a multi-layer structure that includes a thick substrate having a low permittivity. The substrate is supported by a support bracket, and the bandwidth increases to 6.8% by a sleave balun. However, there is a limitation in that it is not easy to manufacture.

As an alternative, the bandwidth of the ZOR antenna increases by strip matching ground. In this case, the fractional bandwidth of the antenna is improved by 8%. The ZOR antenna may also be manufactured in a multi-layer substrate including thin substrates of high permittivity that are stacked on a thick substrate of low permittivity. Another method for solving the bandwidth limitation is to have two resonant frequencies adjacent to each other. Such an antenna includes two resonators having minutely different resonant frequencies. In this case, the bandwidth increases by 3.1%.

FIG. 3 is a diagram illustrating a structure of another small-size antenna with extended bandwidth. Each of unit cells constituting the antenna (hereinafter, referred to as 'prior art 3') shown in FIG. 3 includes an upper patch, a vertical via connecting the upper patch to a ground, and four metal-insulator-metal (MIM) capacitors overlapping adjacent unit cell. Also, a ground plane is divided into an antenna ground, a microstrip feeder ground, and a strip matching ground. Detailed description of dimension of each part will be omitted in FIG. 3. Through the above configuration, the antenna of the prior art 3 may achieve broader impedance matching and smaller size compared to a related-art antenna. However, there is a limitation in that the antenna of the prior art 3 also requires a multi-layer structure in which thin substrates of high permittivity are stacked on a thick substrate of low permittivity, similarly to the prior art 2.

Necessity of development of a small-size antenna having a simple structure and showing extended bandwidth and high efficiency compared to the above-described prior arts is being proposed together with development of portable devices that are gradually miniaturized.

SUMMARY

The present disclosure provides a zeroth-order resonant antenna applicable to wireless communication apparatuses, which has a simple structure producible by a simple process and has extended bandwidth and high efficiency.

According to an exemplary embodiment, a zeroth-order resonant antenna includes: a feeding patch disposed on a top surface of a substrate having a mono-layer structure and configured to receive a signal from the outside; a transmission line including a unit cell disposed on the top surface of the substrate and configured to transmit a signal delivered from the feeding patch; and a pair of ground patches longitudinally disposed on the top surface of the substrate in the same direction as a longitudinal direction of the transmission line around the transmission line, wherein the unit cell includes: an upper patch disposed on the top surface of the substrate and configured to receive a signal; and an inductor unit disposed on the top surface of the substrate to connect between the upper patch and the ground patch and configured to have an adjustable inductance value.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Exemplary embodiments can be understood in more detail from the following description taken in conjunction with the accompanying drawings, in which.

DETAILED DESCRIPTION OF EMBODIMENTS

Hereinafter, exemplary embodiments of a simply fabricable small zeroth-order resonant (ZOR) antenna with extended bandwidth and high efficiency will be described in detail with reference to the accompanying drawings.

Figure 4:
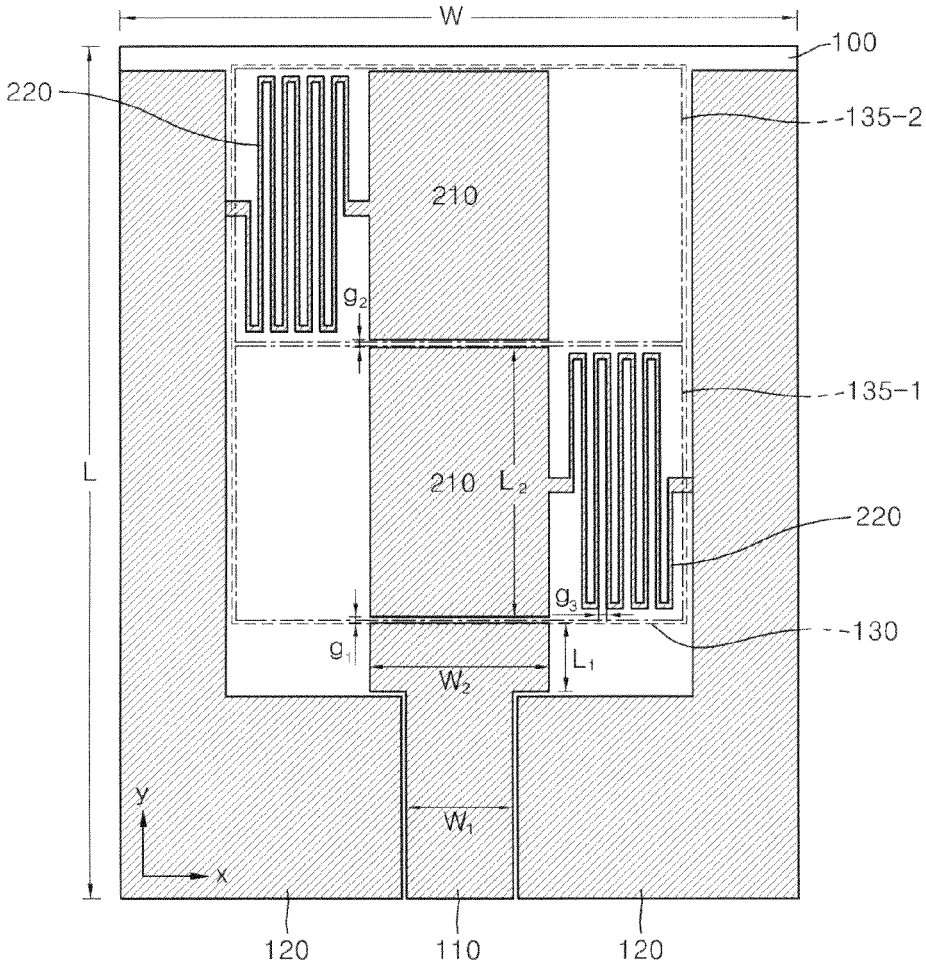
FIG. 4 is a diagram illustrating a simply fabricable small ZOR antenna with extended bandwidth and high efficiency according to an embodiment 1.

FIG. 4 is a diagram illustrating a simply fabricable small ZOR antenna with extended bandwidth and high efficiency according to an embodiment 1.

Referring to FIG. 4, the ZOR antenna according to the embodiment 1 may include a feeding patch 110, a ground patch 120, and a transmission line 130.

The feeding patch 110 may be disposed on the top surface of the substrate 100 to receive signals from the outside. The transmission line 130 may transmit the signals received from the feeding patch 110 along a longitudinal direction, that is, y-axis direction. In this case, since a substrate 100 having a mono-layer structure is used in the ZOR antenna, it is possible to easily manufacture the ZOR antenna compared to the prior arts 2 and 3 described above.

The transmission line 130 may include one or more unit cells 135-1, 135-2, . . . , **135-*n* (hereinafter, referred to as 135) disposed on the top surface of the substrate 100 in a longitudinal direction. When the plurality of unit cells 135 constitute the transmission line 130, the plurality of unit cells 135** may be disposed at a constant interval.

A pair of ground patch 120 may be longitudinally formed in the same direction as the longitudinal direction of the transmission line 130 around the transmission line 130. That is, as shown in FIG. 4, the pair of ground patch 120 may be disposed at both sides of the feeding patch 110 and the transmission line 130, respectively. Also, when the width of the feeding patch 110 is narrower than the unit cell 135 constituting the transmission line 130, the width of the ground patch 120 becomes wider at the both sides of the feeding patch 110.

The ZOR antenna may employ a structure of a coplanar waveguide (CPW) type in which the ground patch 120 is disposed on the same plane of the substrate 100 together with the feeding patch 110 receiving signals from the outside and the transmission line 130 transmitting the received signals. Accordingly, since it is not necessary to include a ground via required when a ground plane is formed on the undersurface of the substrate 100, the structure and fabrication process of the antenna can be simplified.

Figure 5A:
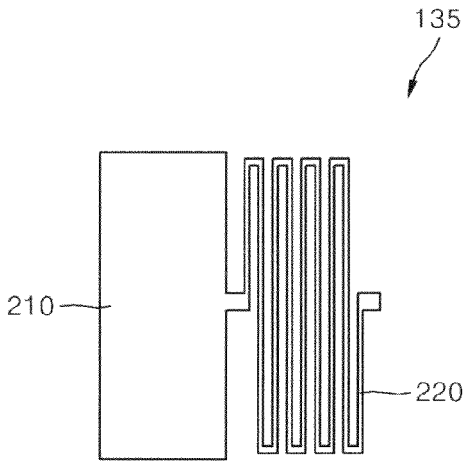
FIGS. 5A and 5B are diagrams illustrating two exemplary configurations in which meander lines are connected to unit cells constituting transmission lines 130, respectively.
Figure 5B:
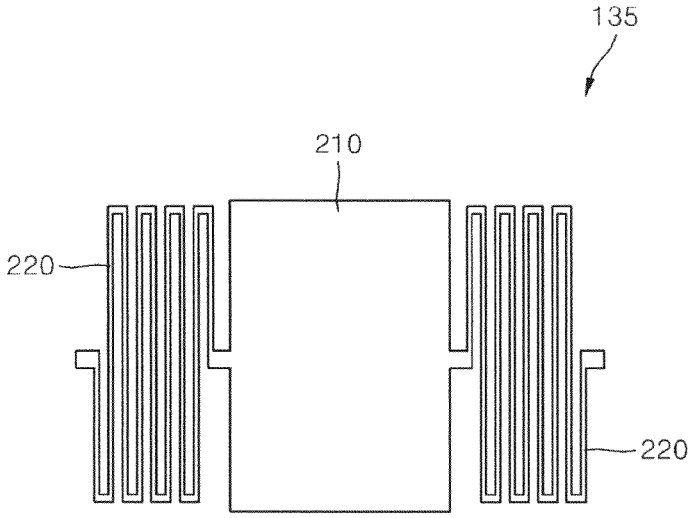

The unit cell 135 constituting the transmission line 130 may include an upper patch 210 disposed on the top surface of the substrate 100 and receiving signals, and an inductor unit connecting the upper patch 210 and the ground patch 120. The inductor unit may be implemented by various elements that have adjustable inductance values. FIG. 4 shows that the inductor unit is implemented by a meander line 220 according to an embodiment 1. FIGS. 5A and 5B are diagrams illustrating two exemplary configurations in which meander lines 220 are connected to unit cells 135 constituting transmission lines 130, respectively The unit cell 135 shown in FIG. 5A may include an upper patch 210 of a rectangular shape and a meander line 220 connected to the one side of the upper patch 210. The unit cell 135 shown in FIG. 5B may include an upper patch 210 of a rectangular shape and a pair of meander lines 220 connected to two opposite sides of the upper patch 210. In the embodiment 1 of the ZOR antenna shown in FIG. 4, the transmission line 130 may include a unit cell 135 as shown in FIG. 5A. A side of an upper patch 210 to which a meander line 220 is connected may be disposed at the opposite location of a side of an upper patch 210 to which a meander line 220 in an adjacent unit cell 135 is connected.

Figure 6:
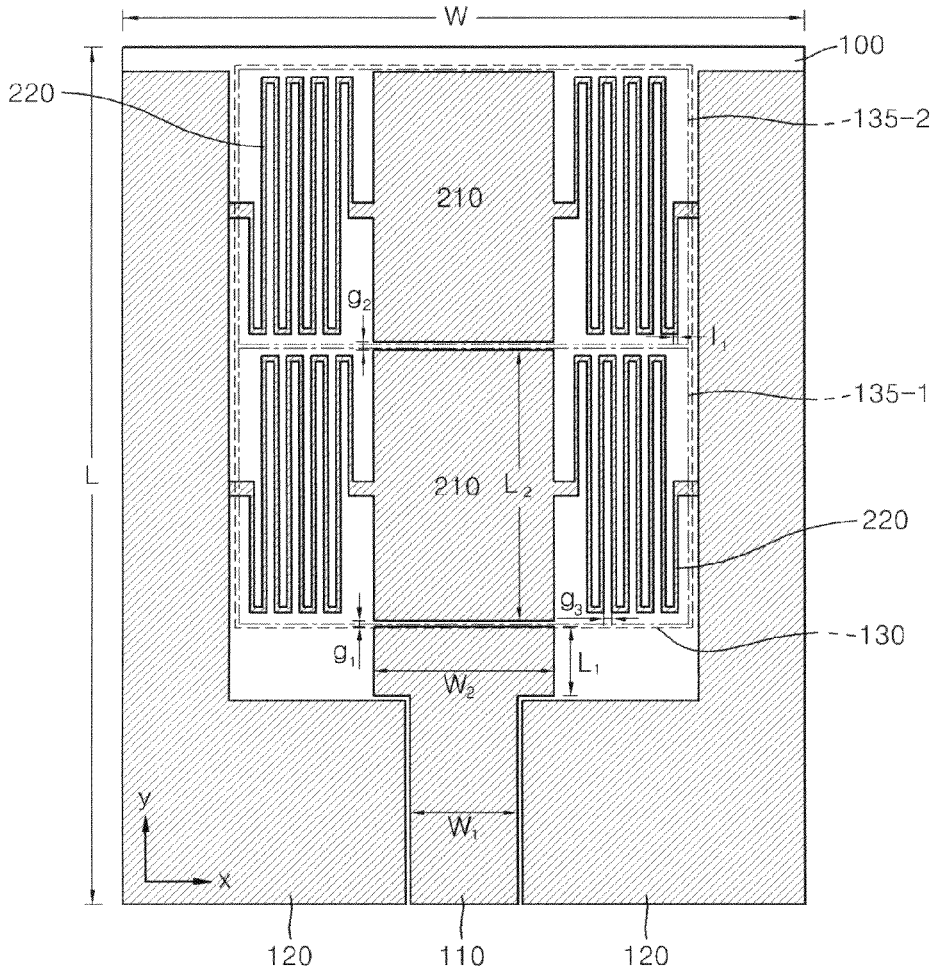
FIG. 6 is a diagram illustrating a ZOR antenna according to an embodiment 2.

On the other hand, FIG. 6 is a diagram illustrating a ZOR antenna according to an embodiment 2. In the embodiment 2 of the ZOR antenna shown in FIG. 6, a transmission line 130 may include a unit cell 135 in which meander lines 220 are connected to both opposite sides of an upper patch as shown in FIG. 5B.

As seen from FIGS. 4 and 6, when the unit cell 135 shown in FIGS. 5A and 5B is disposed on the top surface of a substrate 100, the side of the upper patch 210 to which the meander line 220 is connected may be disposed parallel to the longitudinal direction of the ground patch 120. Accordingly, the meander line 220 may be located at a space between the upper patch 210 and the ground patch 120.

As shown in FIG. 5A, when the unit cell 135 including only one meander line 220 constitutes the transmission line 130, all meander lines 220 may be connected to the same one of the pair of ground patches 120. Alternatively, the meander lines 220 may be randomly connected to one of the pair of ground patches 120. In this case, when the meander lines 220 are symmetrically connected around the upper patch 210, impedance matching is facilitated.

Accordingly, as shown in FIG. 4, a meander line 220 in an adjacent unit cell 135 may be connected to a side of an upper patch 210 opposite to a side of another upper patch 210 to which another meander line 220 is connected. That is, the plurality of meander lines 220 may be connected to the ground patches 120 in an alternate direction along the longitudinal direction of the transmission line 130. A relation between the structure of the unit cell 135 such as the number of the meander lines 220 and the operation of the antenna will be described in detail below.

The number of unit cells 135 constituting the transmission line 130 relates to a gain of an antenna. As described above, since the ZOR antenna has a resonant frequency regardless of its size, the number of unit cell 135 increases. Accordingly, although the size of the antenna increases, the resonant frequency of the antenna may not be changed. However, as the size of the antenna increases, the gain of the antenna may increase. Accordingly, the ZOR antenna according to the embodiment may be designed by selecting an appropriate number of unit cells 135 by adjusting the size and gain of the antenna according to a request of a user.

Figure 7:
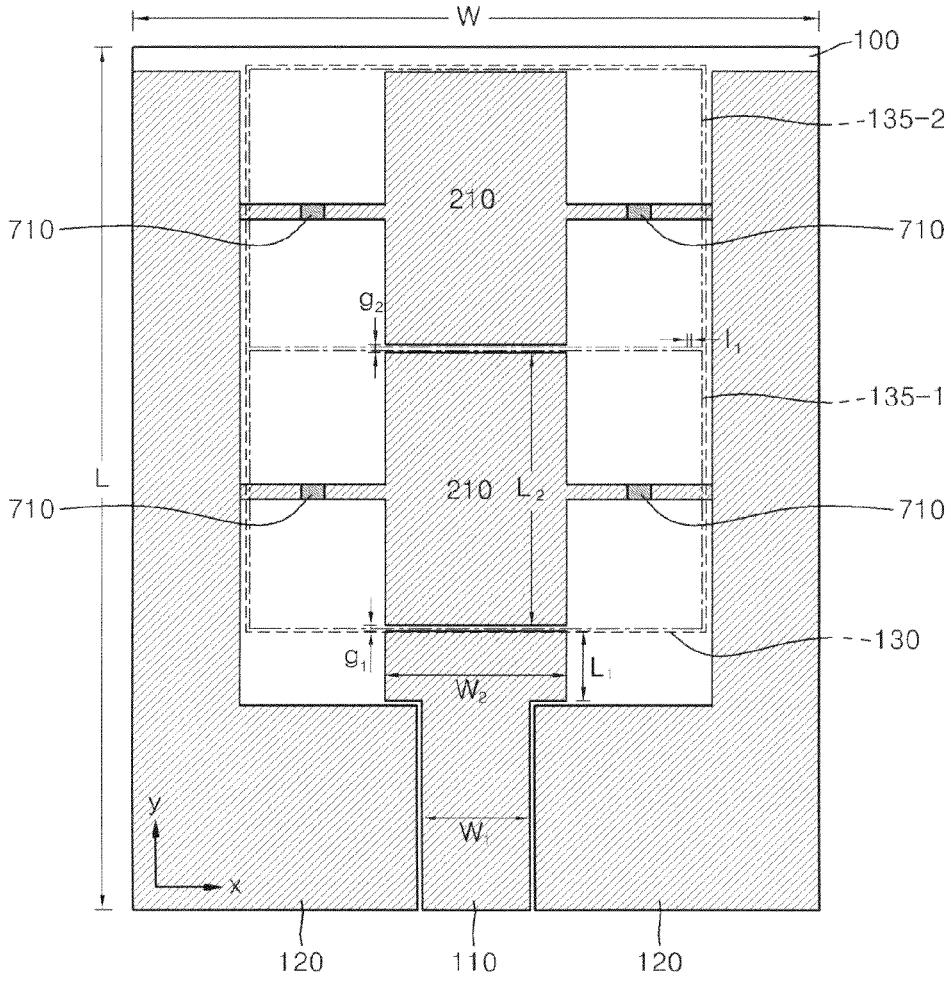
FIG. 7 is a diagram illustrating a ZOR antenna according to an embodiment 3.

FIG. 7 is a diagram illustrating a ZOR antenna according to an embodiment 3. Referring to FIG. 7, a chip inductor 710 may be used as an inductor unit formed on the top surface of the substrate 100 to connect between an upper patch 210 and a ground patch 120 instead of the meander line 220. Accordingly, an antenna may be designed to have a desired resonant frequency when a value of the chip inductor 710 is changed. Also, a distance between a transmission line 130 and the ground patch 120 may be set to a distance that can minimize a value of a parallel capacitance $C_R$ of a Composite Right/Left Handed (CRLH) transmission line to extend a bandwidth. A relation between the parallel capacitance and the bandwidth will be described in detail below.

On the other hand, the inductor unit may be implemented by a spiral inductor to maximize a value of a parallel inductance of the ZOR antenna according to the embodiment. In this case, a distance between the upper patch 210 and the ground patch 120 may be maintained wide such that the value of the parallel capacitance is minimized, and the bandwidth is extended.

Figure 8:
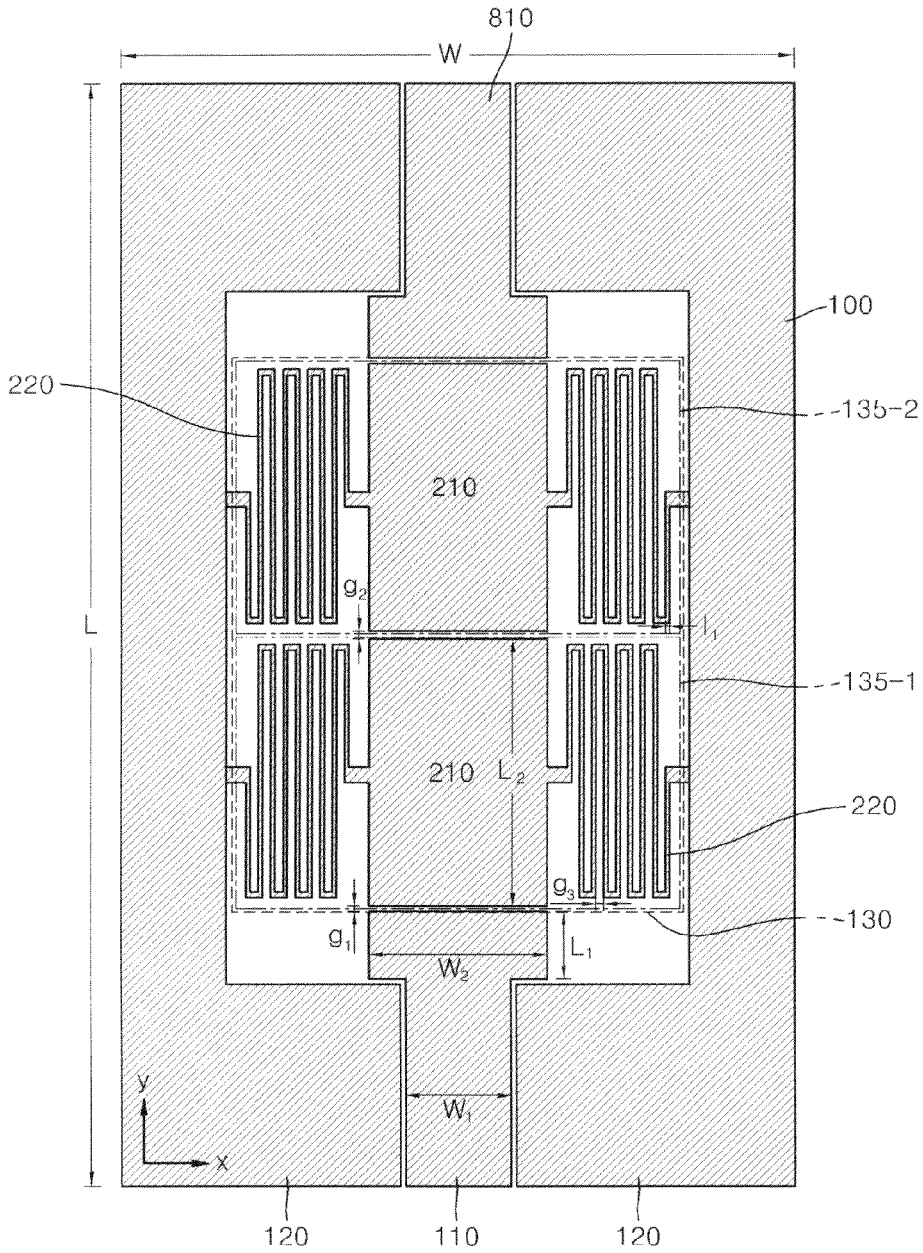
FIG. 8 is a diagram illustrating a ZOR antenna according to an embodiment 4.

FIG. 8 is a diagram illustrating a ZOR antenna according to an embodiment 4. Referring to FIG. 8, an output patch 810 may be further provided to be disposed on the top surface of a substrate 100 and output signals delivered through a transmission line 130 to the outside.

Figure 9:
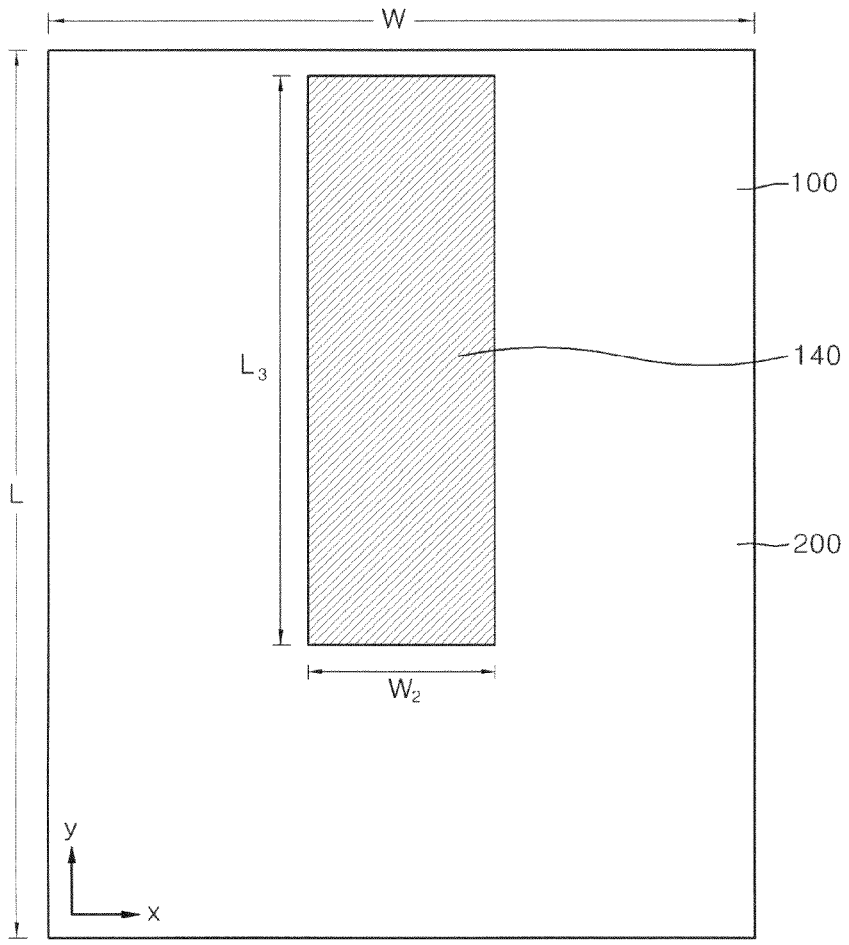
FIG. 9 is a diagram illustrating a configuration of the undersurface of a substrate applicable to ZOR antennas according to the embodiments 1 to 4.

FIG. 9 is a diagram illustrating a configuration of the undersurface of a substrate applicable to ZOR antennas according to the embodiments 1 to 4. Referring to FIG. 9, the ZOR antennas of the embodiments 1 to 4 may further include a feeding patch 110, a ground patch 120, and a lower patch 140 formed on the undersurface 200 of a substrate 100 opposite to the top surface of the substrate 100 on which a transmission line 130 is disposed. The lower patch 140 may be disposed on the undersurface of the substrate 100 to improve impedance matching.

Hereinafter, the operation of ZOR antennas described with reference to FIGS. 4 through 9 will be described in detail.

First, it will be described that the resonant frequency of the ZOR antenna is determined regardless of the size of an antenna.

Figure 10:
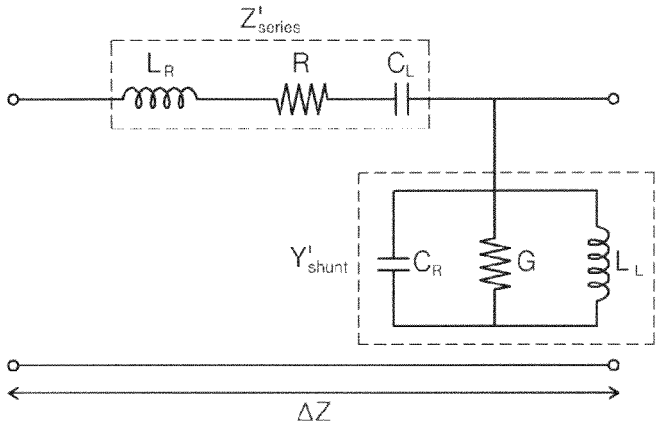
FIG. 10 is a diagram illustrating an equivalent circuit and a dispersion curve of a CRLH transmission line.
Figure 10:
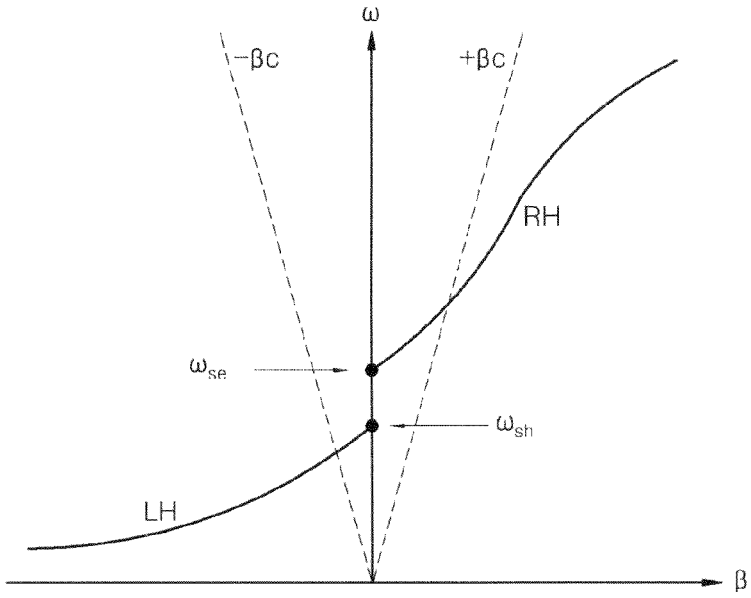

FIG. 10 is a diagram illustrating an equivalent circuit and a dispersion curve of a CRLH transmission line. Referring to FIG. 10A, a typical CRLH transmission line may have a periodic structure in which unit cells including a serial capacitance $C_L$ and a serial inductance $L_R$, and a parallel capacitance $C_R$ and a parallel inductance $L_L$ are consecutively disposed. An immittance of a loss CRLH transmission line may be expressed as the following Equation 1.

$$Z'_{series} = R + j\left(\omega L_R - \frac{1}{\omega C_L}\right) \qquad (1)$$
$$Y'_{shunt} = G + j\left(\omega C_R - \frac{1}{\omega L_L}\right)$$

where R and G denote a parallel resistance and a parallel capacitance of a loss CRLH transmission line, respectively.

Serial and parallel resonant frequencies may be expressed as the following Equation 2.

$$\omega'_{se} = \frac{1}{\sqrt{L_R C_L}}\text{rad/s} \qquad (2)$$
$$\omega'_{sh} = \frac{1}{\sqrt{L_L C_R}}\text{rad/s}$$

Accordingly, a complex propagation constant γ and a characteristic impedance $Z_C$ may be expressed as the following Equations 3 and 4, respectively.

$$\gamma = \alpha + j\beta = \sqrt{Z'_{series} Y'_{shunt}} \qquad (3)$$

$$Z_C = \sqrt{\frac{Z'_{series}}{Y'_{shunt}}} = \sqrt{\frac{L_L}{C_L}}\sqrt{\frac{(\omega/\omega_{se})^2 - 1}{(\omega/\omega_{sh})^2 - 1}} \qquad (4)$$

Since the CRLH transmission line has a periodic boundary condition, Block-Floquet theory may be applied. A dispersion relation may be determined by the following Equation 5.

$$\beta(\omega) = \frac{s(\omega)}{\rho}\sqrt{\omega^2 L_R C_R + \frac{1}{\omega^2 L_L C_L} - \frac{L_R C_L + L_L C_R}{L_L C_L}} \qquad (5)$$

where s(ω) is a sinusoidal function.

For example, $\omega_{se}$ and $\omega_{sh}$ may be different in a dispersion diagram of an unbalanced LC-based CRLH transmission line as shown in FIG. 10B. An infinite wavelength may be supported at such a resonant frequency when β=0. According to the theory of an open-type resonator having a CRLH transmission line, resonance may be generated in a condition satisfying the following Equation 6.

$$\beta_n = \frac{n\pi}{l}(n = 0, \pm 1, \ldots, \pm(N-1)) \qquad (6)$$

where l, n, and N denote a physical length of a resonator, a mode number, and the number of unit cells.

When n=0 in Equation 6, a wavelength becomes infinite. A resonant frequency of zeroth-order mode becomes independent of the size of the antenna. In this case, the shortest length of the open-type resonator may be about ½ of the wavelength. Accordingly, an antenna having a smaller size can be implemented.

As shown in FIG. 10B, two resonant frequencies $\omega_{se}$ and $\omega_{sh}$ may be observed together with a matched load in the unbalanced CRLH transmission line. Considering an open-type transmission line in which $Z_L=\infty$, an input impedance $Z_{in}$ seen from one end of the resonator to the other end of the resonator may be expressed as the following Equation 7.

$$Z_{in}^{open} = -jZ_c\cot(\beta\ell)\overset{\beta\to 0}{\approx} -jZ_c\frac{1}{\beta\ell} = -j\sqrt{\frac{Z'_{series}}{Y'_{shunt}}}\left(\frac{1}{-j\sqrt{Z'_{series}Y'_{shunt}}}\right)\frac{1}{\ell} = \frac{1}{Y'_{shunt}\ell} = \frac{1}{Y'_{shunt}(N\Delta z)} \tag{7}$$

where the input impedance of the open-type resonator is $$\frac{1}{N}\frac{1}{Y'_{shunt}},$$

and values of equivalent L, C and G are $$\frac{L_L}{N},\ NC_R,\ \text{and}\ \frac{1}{NG},$$

respectively.

A resonant frequency of an open-type zeroth-order resonant circuit including N unit cells may be determined by a resonant frequency derived from a parallel LC tank $Y'_{shunt}$, regardless of N. Accordingly, a resonant frequency of the open-type zeroth-order resonant antenna may be determined as $\omega_{sh}$ that is the parallel resonant frequency of Equation 2, and therefore, the resonant frequency may depend only on a parallel parameter of the unit cell.

Hereinafter, detailed description of the bandwidth of ZOR antenna will be made in detail. As described above, considering the open-type resonator depends only on $Y'_{shunt}$ of the unit cell, the average electric energy stored in a parallel capacitor $C_R$ may be expressed as the following Equation 8.

$$W_e = \frac{1}{4}|V^2|NC_R \tag{8}$$

where V is a voltage applied to a parallel capacitor.

Also, the average magnetic energy stored in the parallel inductor $L_L$ may be expressed as the following Equation 9.

$$W_e = \frac{1}{4}|I_L|^2\frac{L_L}{N} = \frac{1}{4}|V|^2\frac{N}{\omega^2 L_L} \tag{9}$$

where $I_L$ is a current applied to a parallel inductor.

When $W_m$ is equal to $W_e$, resonance may occur. Accordingly, quality factor may be expressed as the following Equation 10.

$$Q = \omega\frac{(\text{averageenergystored})}{(\text{energyloss/second})} \tag{10}$$

-continued $$= \omega_{sh}\frac{2W_m}{P_{loss}} = \frac{1/NG}{\omega_{sh}(L_L/N)} = \frac{1/G}{\omega_{sh}L_L} = \omega_{sh}(1/NG)\cdot NC_R = \omega_{sh}(1/G)C_R = \frac{1}{G}\sqrt{\frac{C_R}{L_L}}$$

As a result, in an open-type, the fractional bandwidth of a resonator may be expressed as the following Equation 11.

$$BW = GX\sqrt{\frac{L_L}{C_R}} \tag{11}$$

The above relational expression does not consider impedance matching in an input terminal, but may provide intuitive concept that can efficiently increase the bandwidth.

As described above, a typical ZOR antenna may have a limitation of a narrower bandwidth than a related-art resonant antenna. This is because the quality factor of a ZOR antenna relates to only $C_R$ and $L_L$. For example, $L_L$ and $C_R$ in a microstrip structure may be implemented by a parallel plate and a shorting pin (via) between an upper patch and a lower patch. Since $L_L$ in a microstrip line depends only on the length of the via, the microstrip structure may restrict a value of $L_L$. Also, since the thickness and size of a substrate determines capacitance of the parallel plate, the microstrip line may have a large value of $C_R$.

As a result, a narrow bandwidth may be obtained from a small value of $L_L$ and a large value of $C_R$ according to Equation 11, and a ZOR antenna in the microstrip technology may have a narrow bandwidth according to a structural limitation. In order to extend the bandwidth of the microstrip structure, a thick substrate of a low permittivity may be utilized, but this may make a process difficult and restrict the freedom of design as described above.

According to the embodiments 1 to 4 shown in FIGS. 4 through 8, it is possible to implement a ZOR antenna that solves a bandwidth limitation by high $L_L$ and low $C_R$ while being minimized in its size.

In the parallel resonant frequency of Equation 2, the parallel inductance $L_L$, which is an inductance value of the inductor unit, may be determined by the length of the meander line 220 or elements such as a chip inductor having an adjustable inductance value. Also, the parallel capacitance $C_R$, which is a capacitance value between the upper patch 210 and the ground patch 120, may be reduced as a space between the upper patch 210 and the ground patch 120 becomes wider. When the lower patch 140 is provided, the $C_R$ value may be changed by a $W_3$ value that is the width of the lower patch 140. As the $W_3$ value increases, the $C_R$ value may also increases.

Figure 11:
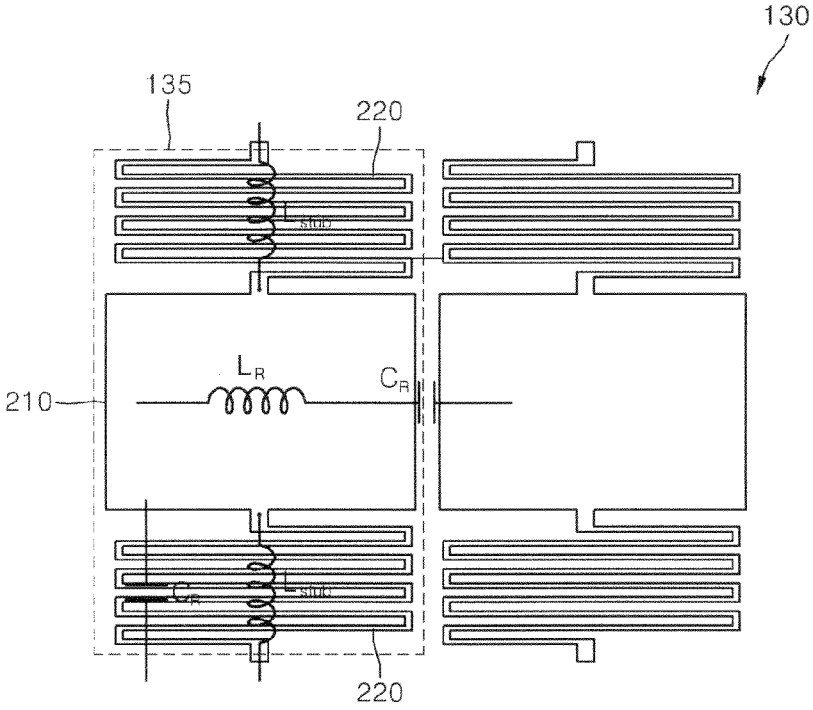
FIG. 11 is a diagram illustrating an equivalent circuit of a unit cell 135 constituting a transmission line 130.
Figure 11:
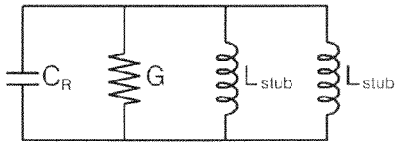
Figure 11:
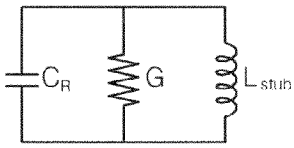

FIG. 11 is a diagram illustrating an equivalent circuit of a unit cell 135 constituting a transmission line 130. FIG. 11A illustrates circuit parameters determined by each part of one unit cell 135. FIG. 11B illustrates an equivalent circuit of the unit cell 135 having the same configuration as shown in FIG. 5B. FIG. 11C illustrates an equivalent circuit of the unit cell 135 having the same configuration as shown in FIG. 5A. Referring to FIG. 11, parallel parameters of a ZOR antenna according to an embodiment may be realized by a parallel capacitance between the upper patch 210 and the ground patch 120 and a parallel inductance of the meander line 220.

Also, when the unit cell 135 has the same configuration as shown in FIG. 5*b*, the parallel inductance $L_L$ may be about a half of the inductance $L_{stub}$ of the meander line 220. Accordingly, when the meander line 220 is connected to only one side of the upper patch 210 as shown in FIG. 5A, the size of the resonant frequency can be adjusted without changing the size of the ZOR antenna according to the embodiment.

Specifically, a resonant frequency when the unit cell 135 has an asymmetrical configuration as shown in FIG. 5A and a resonant frequency when the unit cell 135 has a symmetrical configuration as shown in FIG. 5B may be obtained from the following Equation 12.

$$\omega_{sh-asym} = \frac{1}{\sqrt{L_{stub}C_R}}\,[\text{rad/s}] \tag{12}$$

$$\omega_{sh-sym} = \frac{1}{\sqrt{(L_{stub}+L_{stub})C_R}} = \frac{1}{\sqrt{2}}\frac{1}{\sqrt{L_{stub}C_R}} = \frac{1}{\sqrt{2}}\omega_{sh-asym}[\text{rad/s}]$$

where $\omega_{sh\text{-}asym}$ is a resonant frequency when the unit cell 135 has the same configuration as shown in FIG. 5A, and $\omega_{sh\text{-}sym}$ is a resonant frequency when the unit 135 has the same configuration as shown in FIG. 5B.

Since the transmission line 130 of the ZOR antenna according to the embodiment high degree of freedom in design compared to a microstrip line, a wider bandwidth and a smaller size can both be achieved by appropriate design. Therefore, the meander line 220 may enable implementation of a short stub as well as a large $L_L$. Since the upper patch 210 is disposed at a place distant from the ground patch 120, $C_R$ may be small compared to the microstrip structure, and allow the bandwidth to be extended.

Inductance may increase in proportion to the length of a short stub line like the meander line 220. Accordingly, when the meander line 220 is used, a large $L_L$ can be realized in a limited space. Also, since the transmission line 130 and the ground patch 120 are disposed on the same plane, parallel capacitance between the upper patch 210 and the ground patch 120 can be easily adjusted. As a result, a short parameter can be very easily changed by the CPW-type structure and the meander line 220.

In case of impedance matching, the stub of the top surface of the substrate 100 and a portion of the lower patch 140 may be utilized. The width and length of the stub may play an important role in the impedance matching. Also, when the length of the lower patch 140 is lengthened, coupling capacitance of a feeding network may increase. This may be utilized to obtain excellent impedance matching.

Figure 12:
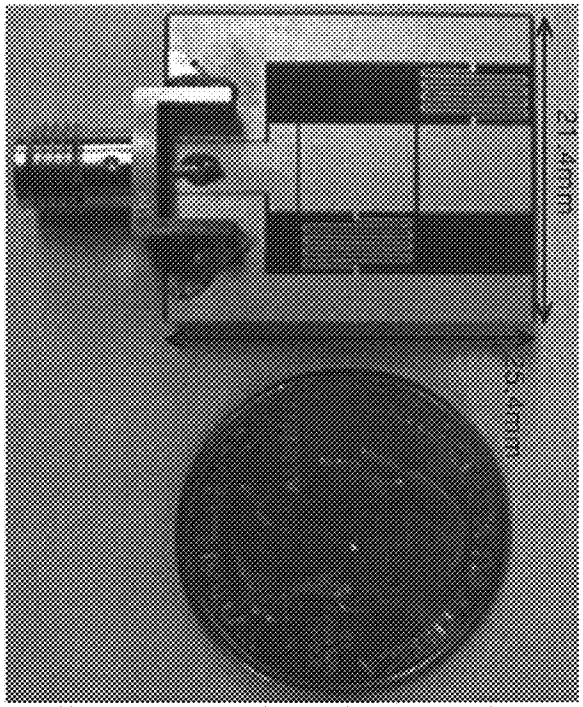
FIG. 12 is a diagram illustrating a configuration of an actual antenna implemented with the ZOR antenna of FIG. 4 according to the embodiment 1.

FIG. 12 is a diagram illustrating a configuration of an actual antenna implemented with the ZOR antenna of FIG. 4 according to the embodiment 1. A Rogers RT/Duroid 5880 substrate having permittivity of about 2.2 may be used for the substrate of the antennal. A CPW feeding line of about 50Ω and proximity coupling may be used as a feeding network to match input impedance to about 50Ω. The resonant frequency of the antenna may be determined $L_{stub}$ and $C_R$ as described above. $L_L$ and the resonant frequency may vary according to the change of the length of the meander line 220. Since the ZOR antennal according to the embodiment is manufactured in CPW type, and is printed on the top surface and undersurface of a substrate without a via, its fabrication is easy, and its profile has a low shape.

The antenna of FIG. 12 may have a small size of about 21.4 mm×25.4 mm×1.6 mm, and may be implemented to operate in a zeroth-order mode at a resonant frequency of about 1.5 GHz. The electrical size of the antenna may be about $0.107\lambda_0\times0.127\lambda_0\times0.008\lambda_0$ at about 1.5 GHz, and the electrical size of the unit cells 135 may be about $0.072\lambda_0\times0.04\lambda_0$. Also, the dimension of each part is as follows. The unit is millimeter (mm). $L_1$=2, $L_2$=7.8, $L_3$=17.8, $W_1$=3.4, $W_2$=6, $W_3$=9, $g_1$=0.1, $g_2$=$g_3$=0.2, and $I_1$=0.2.

Figure 13:
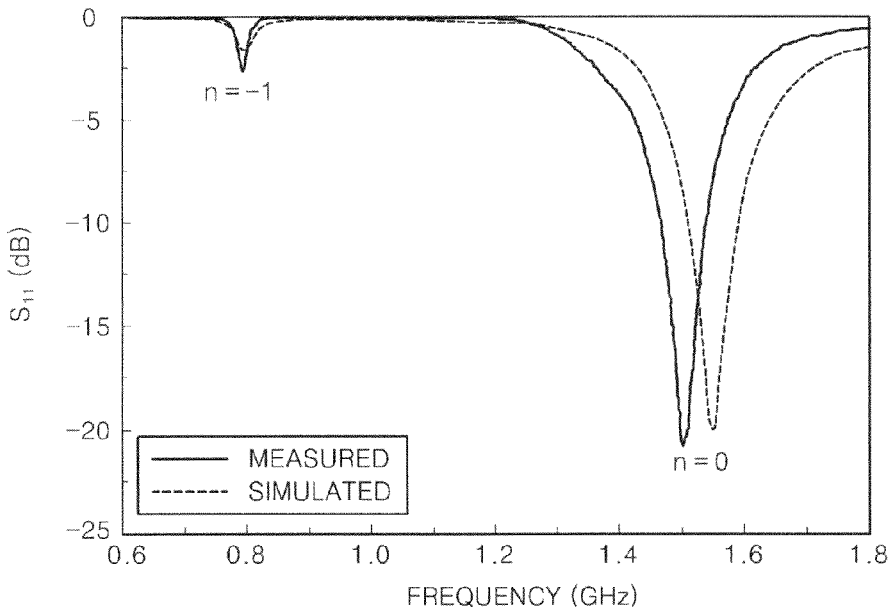
FIG. 13 is a graph illustrating a reflection loss according to a frequency of the antenna of FIG. 12.

FIG. 13 is a graph illustrating a reflection loss according to a frequency of the antenna of FIG. 12. Referring to FIG. 13, a reflection loss value obtained by a result of simulation and a reflection loss value obtained by a result of measurement are shown according to the frequency. Here, a ZOR frequency may be about 1.5 GHz, and a 10 dB bandwidth may be about 4.8%.

Figure 14:
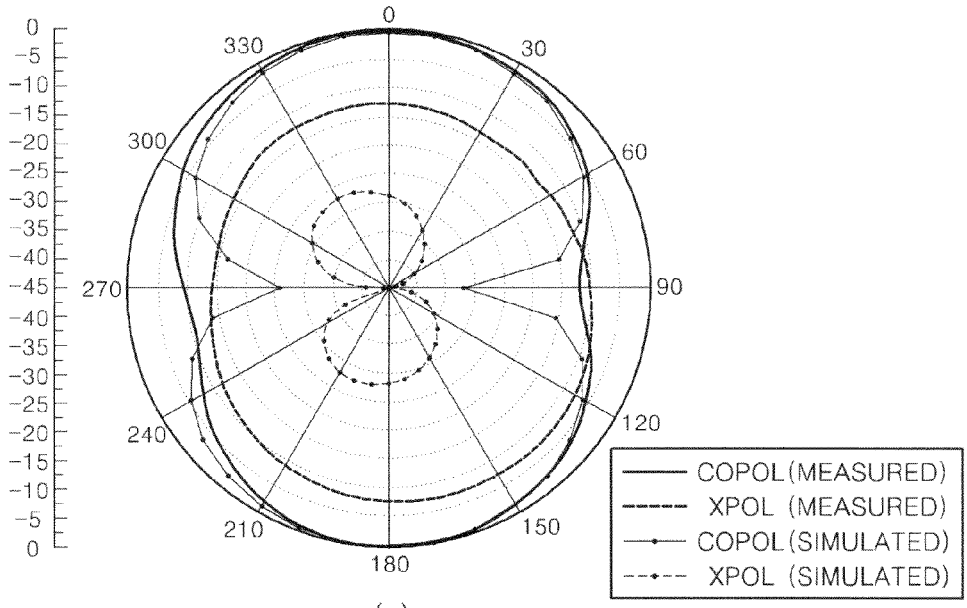
FIG. 14 is a diagram illustrating a radiation pattern of the antenna of FIG. 12 at about 1.5 GHz.
Figure 14:
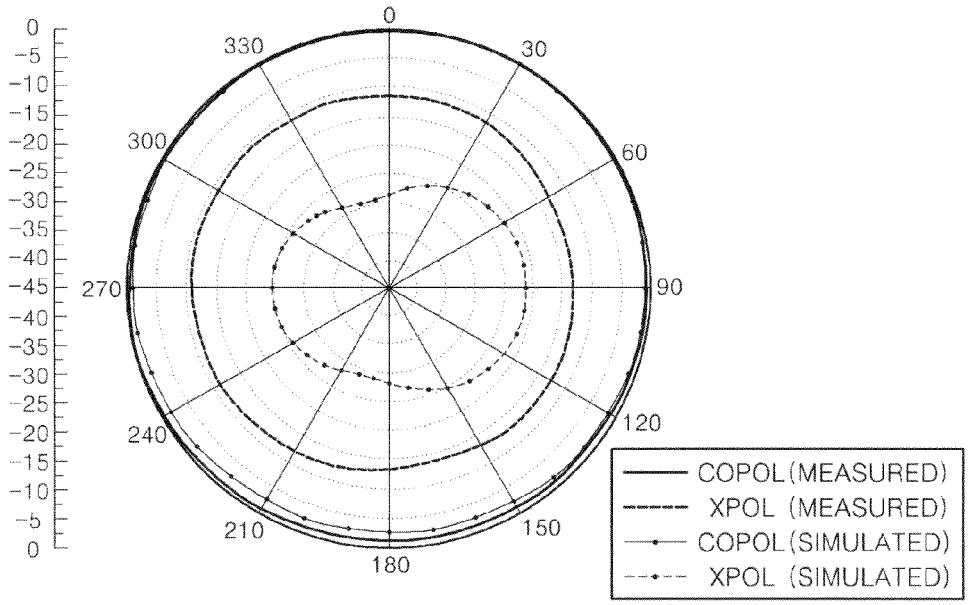
Figure 15:
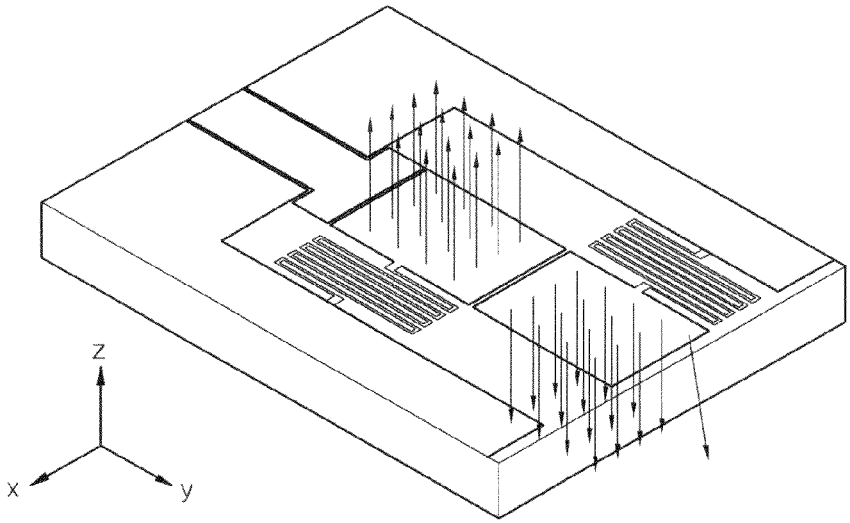
FIG. 15 is a diagram illustrating an electric field distribution of an antenna of FIG. 12.
Figure 15:
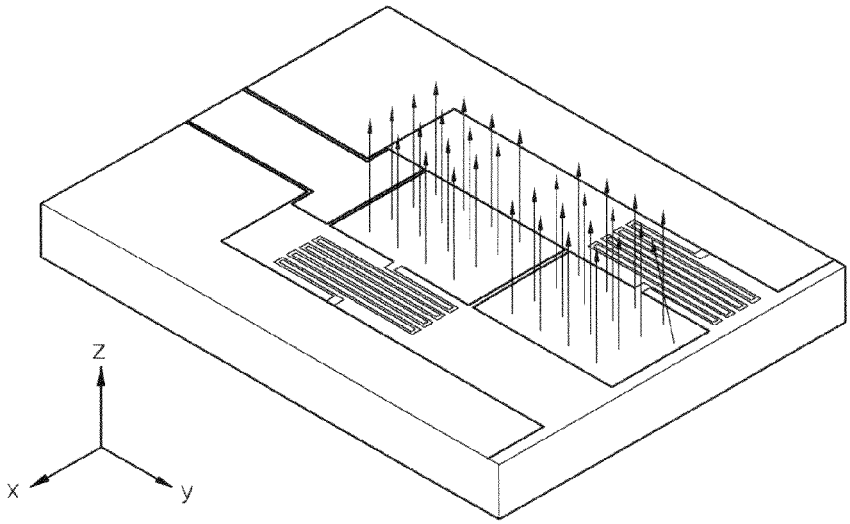

FIG. 14 is a diagram illustrating a radiation pattern of the antenna of FIG. 12 at about 1.5 GHz. FIG. 14A illustrates an E-plane, that is, a radiation pattern in the y-z plane, and FIG. 14B illustrates an H-plane, that is, a radiation pattern in the x-z plane. The measured radiation efficiency may be about 42.5%. Also, FIG. 15 is a diagram illustrating an electric field distribution of an antenna of FIG. 12. FIG. 15A illustrates an electric field distribution when n=−1, and FIG. 15B illustrates an electric field distribution when n=0. Referring to FIG. 15A, the electric field shows a distribution of 180° out-of-phase in adjacent unit cells when n=−1. Referring to FIG. 15B, the electric field shows a distribution of in-phase when n=0.

Figure 16:
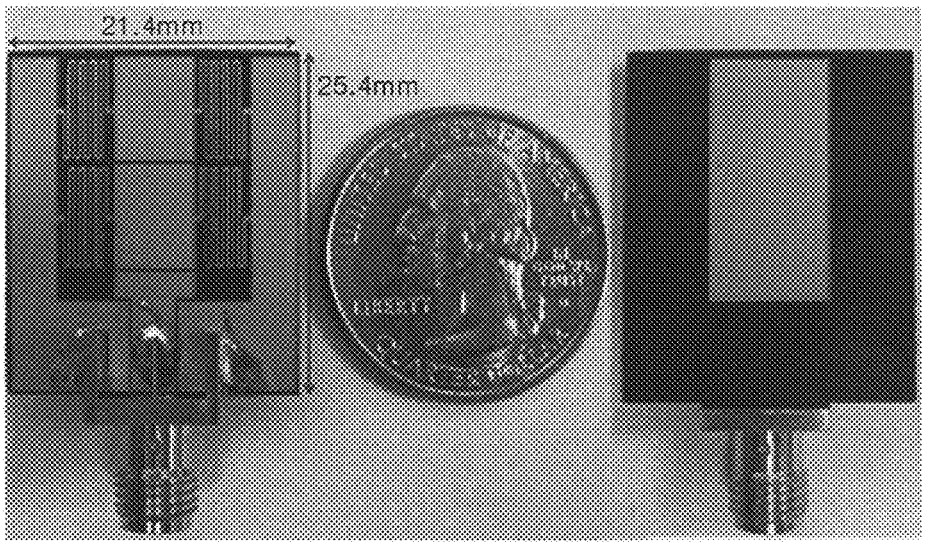
FIG. 16 is a diagram illustrating a configuration of an actual antenna implemented with the ZOR antenna of FIG. 6 according to the embodiment 2.

FIG. 16 is a diagram illustrating a configuration of an actual antenna implemented with the ZOR antenna of FIG. 6 according to the embodiment 2. The dimension of each part of the antenna may be designed to be identical to those of the antenna of FIG. 12. Parameters of the unit cells included in the antenna of FIG. 16 may be as follows. $C_R$=0.62 pF, $L_L$=9.26 nH, and G=0.0007. The antenna of FIG. 16 may have a ZOR frequency of about 2.03 GHz, and the electrical size of the unit cell may be about $0.097\lambda_0\times0.053\lambda_0$. Also, the electrical size of the antenna of FIG. 16 may be about $0.145\lambda_0\times0.172\lambda_0\times0.011\lambda_0$ (about 21.4 mm×25.4 mm×1.6 mm).

Figure 17:
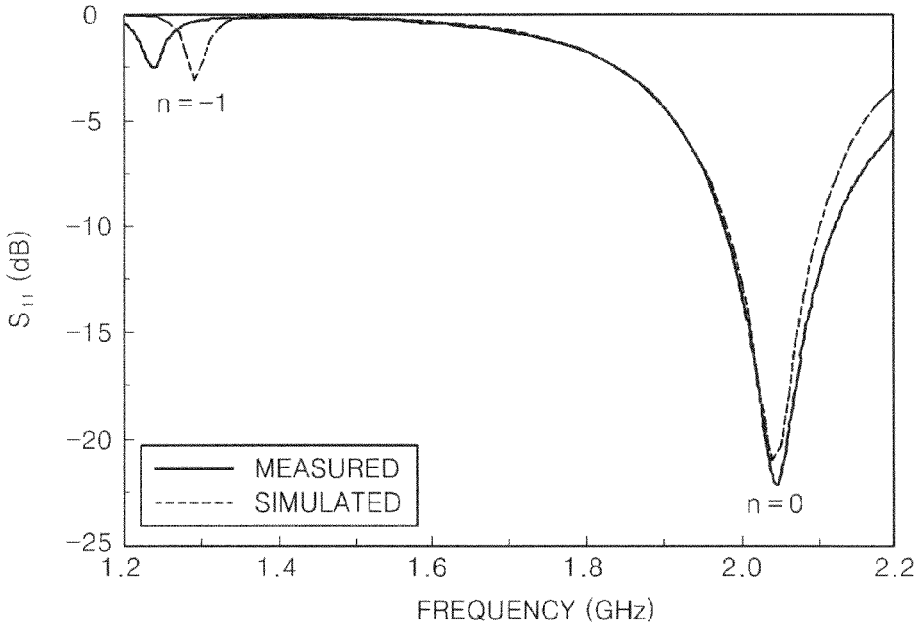
FIG. 17 is a graph illustrating a reflection loss according to a frequency of the antenna of FIG. 16.

FIG. 17 is a graph illustrating a reflection loss according to a frequency of the antenna of FIG. 16. Referring to FIG. 17, a reflection loss value obtained by a result of simulation and a reflection loss value obtained by a result of measurement are shown according to the frequency. Here, a ZOR frequency may be about 2.03 GHz, and a 10 dB bandwidth and a radiation efficiency may be about 6.8% and 62%.

Figure 18:
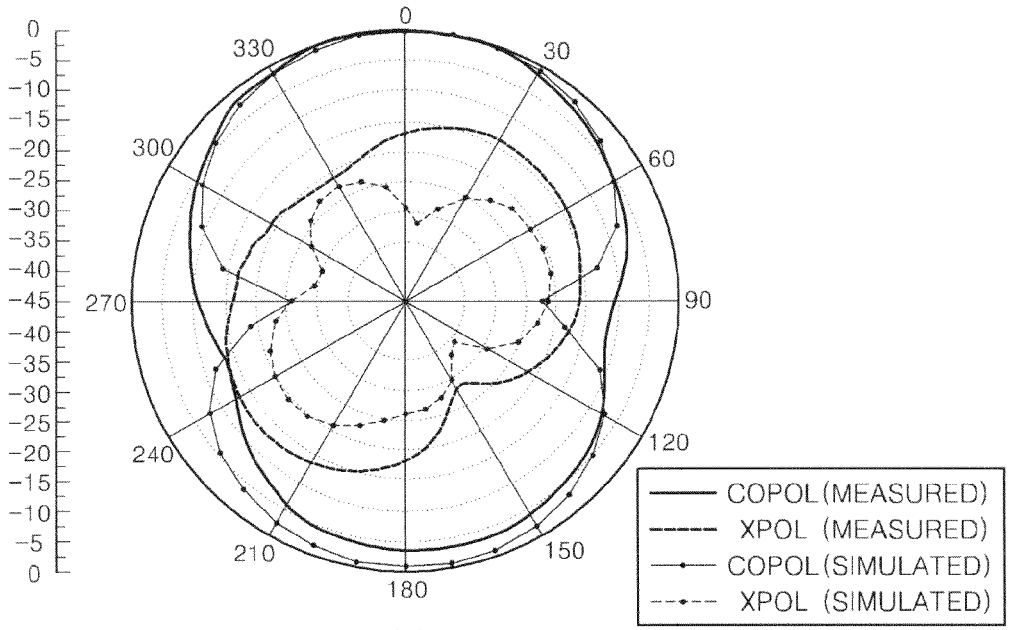
FIG. 18 is a diagram illustrating a radiation pattern of the antenna of FIG. 16 at about 2.03 GHz.
Figure 18:
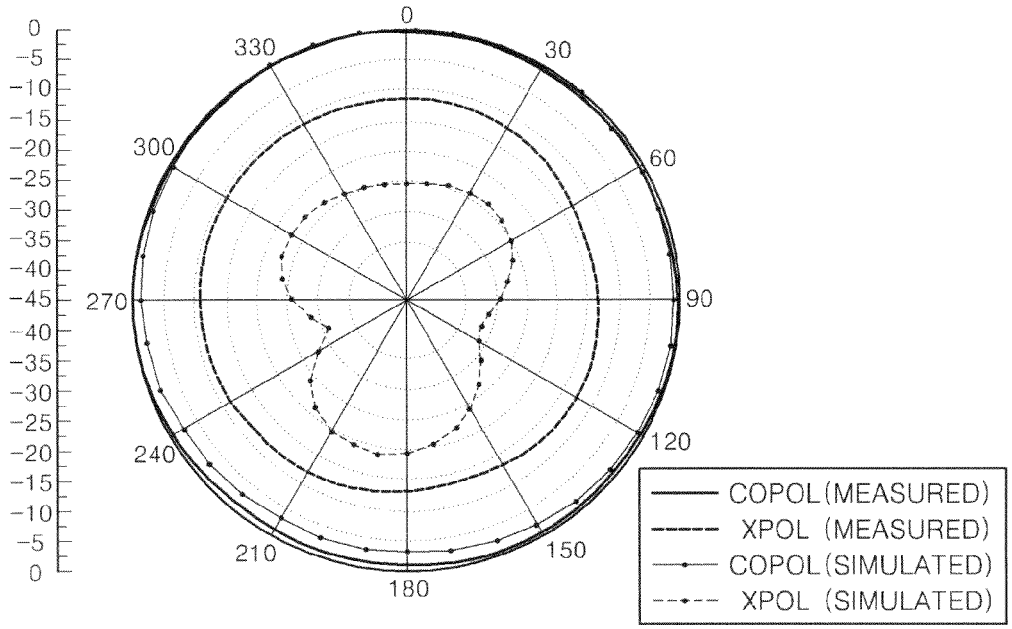
Figure 19:
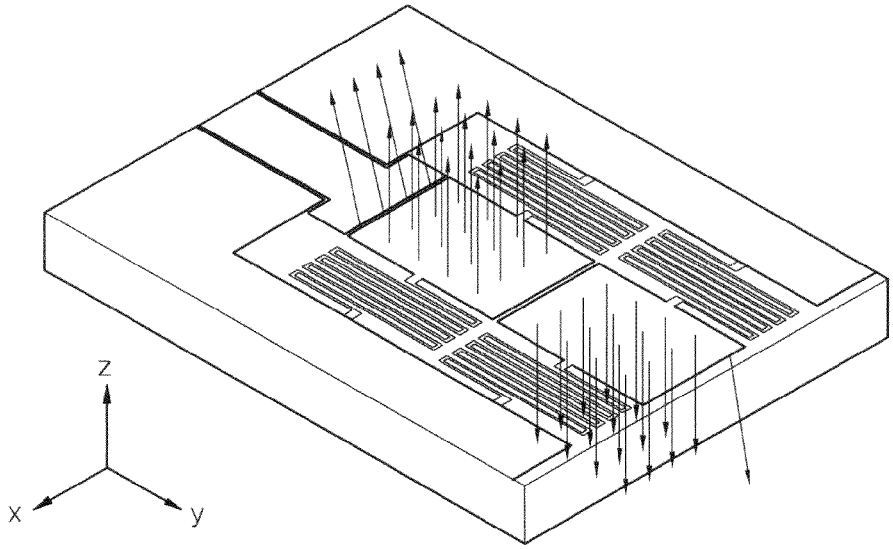
FIG. 19 is a diagram illustrating an electric field distribution of an antenna of FIG. 16.
Figure 19:
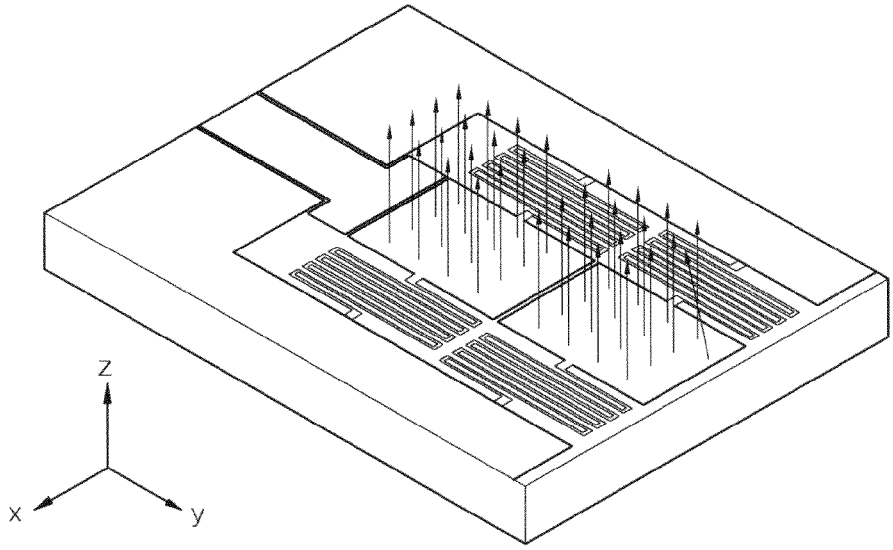

FIG. 18 is a diagram illustrating a radiation pattern of the antenna of FIG. 16 at about 2.03 GHz. FIG. 18A illustrates an E-plane, that is, a radiation pattern in the y-z plane, and FIG. 18B illustrates an H-plane, that is, a radiation pattern in the x-z plane. The measurement result of the radiation pattern of a ZOR antenna according to the embodiment shows uniform radiation pattern in all directions similarly to the simulation result. Also, FIG. 19 is a diagram illustrating an electric field distribution of an antenna of FIG. 16. FIG. 19A illustrates an electric field distribution when n=−1, and FIG. 19B illustrates an electric field distribution when n=0. Referring to FIG. 19A, the electric field shows a distribution of 180° out-of-phase in adjacent unit cells when n=−1. Referring to FIG. 15B, the electric field shows a distribution of in-phase when n=0.

The following Table 1 shows structural characteristics and operational characteristics of the ZOR antennas according to the embodiments 1 and 2 and antennas according to the prior arts 1 to 3 described above.

TABLE 1

| | Embodiment 1 | Embodiment 2 | Prior Art 1 | Prior Art 2 | Prior Art 3 |
|---|---|---|---|---|---|
| Resonant Frequency (GHz) | 1.5 | 2.03 | 3.38 | 1.77 | 1.73 |
| Electrical Size ($\lambda_0$) | 0.072 × 0.04 × 0.008 | 0.097 × 0.053 × 0.011 | 0.16 × 0.08 × 0.011 | 0.09 × 0.077 × 0.036 | 0.1 × 0.1 × 0.015 |
| Bandwidth (%) | 4.8 | 6.8 | ~0.1 | 6.8 | 8 |
| Efficiency (%) | 42.5 | 62 | 70 | 54 | — |
| Via Process | Unnecessary | Unnecessary | Necessary | Necessary | Necessary |
| Layer | Single-layer | Single-layer | Single-layer | Multi-layer | Multi-layer |

Referring to Table 1, the ZOR antennas according to the embodiments 1 and 2 may have relatively smaller electrical size than those of the prior arts 1 through 3, and may not require a via process. Accordingly, since a feeding patch 110, a ground patch 120 and a transmission line 130 may all be disposed on the top surface of the substrate, a process for manufacturing the antennas can be simplified. Also, a substrate having a plurality of layers having different permittivities like in the prior arts 2 and 3 is not used, the ZOR antenna according to the embodiment may have a simple structure.

In terms of operation characteristics of the antenna, the ZOR antenna according to the embodiment may have a considerably extended bandwidth compared to the prior art 1 that employs a mono-layer substrate similarly to the embodiment, and have relatively high efficiency compared to the prior art 2 that requires a via process and includes a multi-layer substrate.

Figure 20:
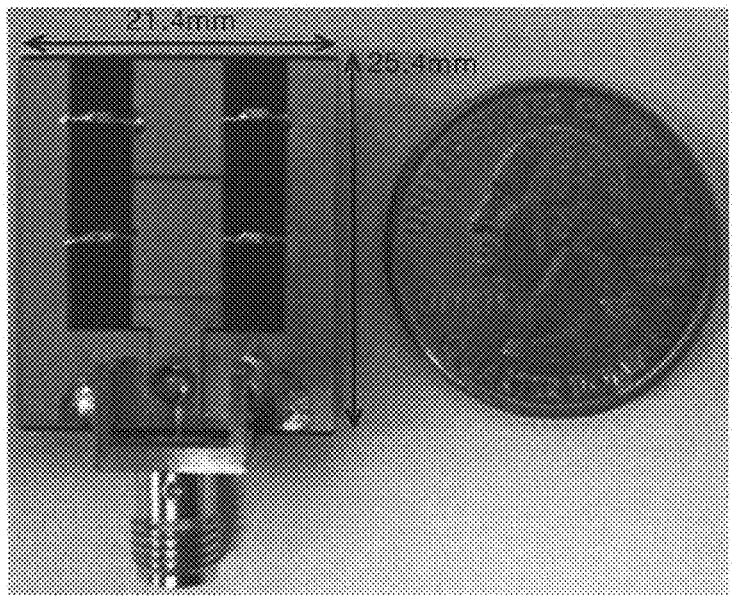
FIG. 20 is a diagram illustrating a configuration of an actual antenna implemented with the ZOR antenna of FIG. 7 according to the embodiment 3.

FIG. 20 is a diagram illustrating a configuration of an actual antenna implemented with the ZOR antenna of FIG. 7 according to the embodiment 3. The inductor unit of the antenna of FIG. 20 is implemented with a chip inductor that is a lumped element instead of a meander line that is a short stub. Since the antenna of FIG. 20 has high parallel inductance, the antenna of FIG. 20 may be suitable for devices using low frequencies. The antenna may be implemented by a chip inductor of high frequency having an inductance of about 8.2 nH, and may have a ZOR frequency of about 2.38 GHz and radiation efficiency of about 77.8%. Dimension of each part of the antenna of FIG. 20 may be identical to those of the embodiments 1 and 2 described above. The electrical size of a unit cell included in the antenna of FIG. 20 may be about $0.128\lambda_0 \times 0.053\lambda_0$ at about 2.38 GHz, and the entire electrical size of the antenna may be about $0.170\lambda_0 \times 0.201\lambda_0 \times 0.012\lambda_0$ (21.4 mm×25.4 mm×1.6 mm).

Figure 21:
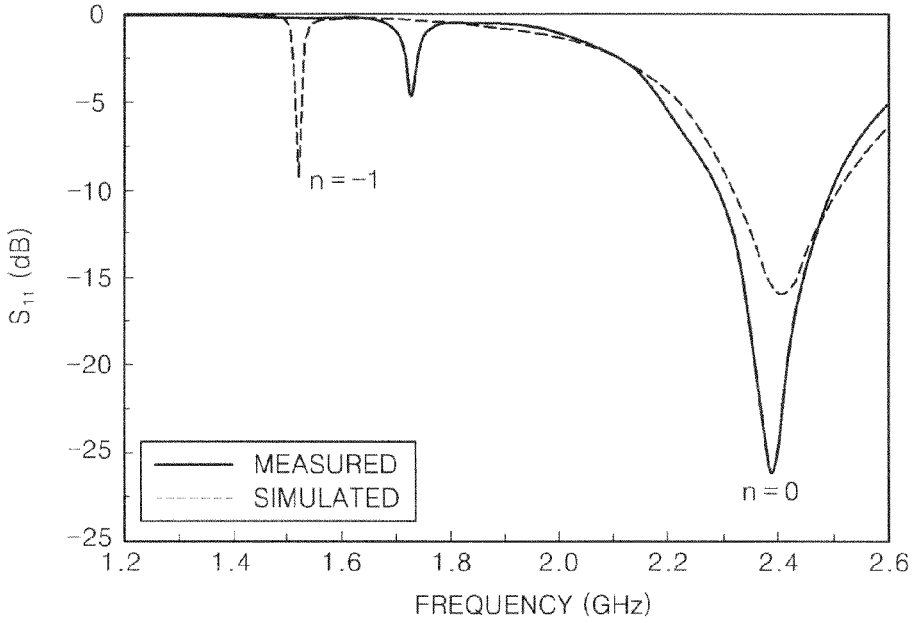
FIG. 21 is a graph illustrating a reflection loss according to a frequency of the antenna of FIG. 20.
Figure 22:
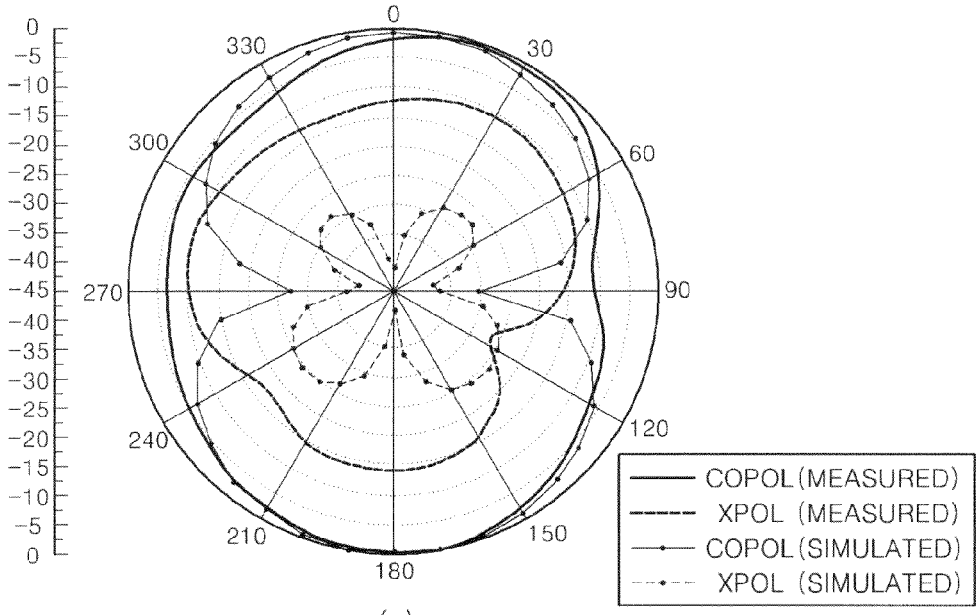
FIG. 22 is a diagram illustrating a radiation pattern of the antenna of FIG. 20 at about 2.38 GHz.
Figure 22:
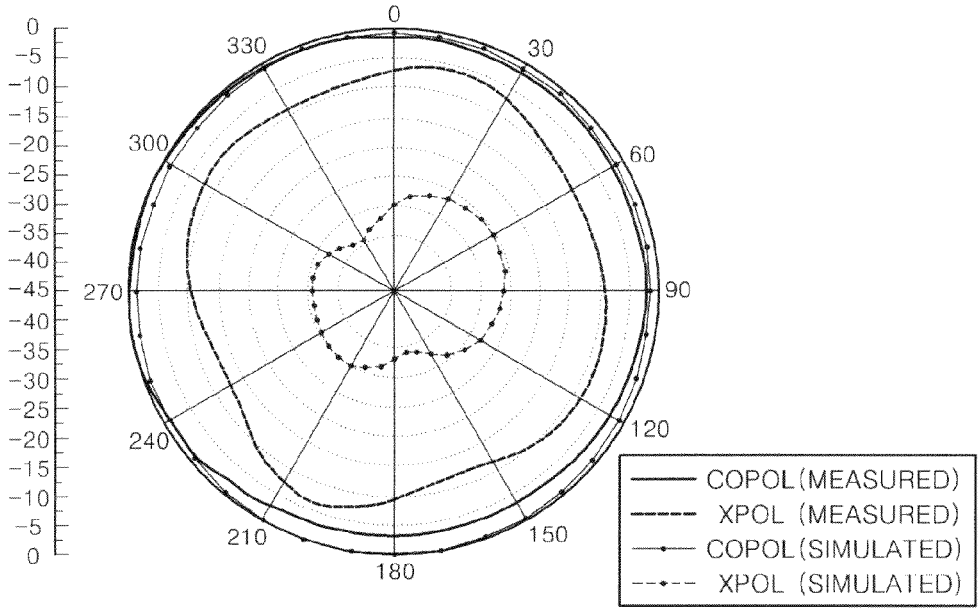

FIG. 21 is a graph illustrating a reflection loss according to a frequency of the antenna of FIG. 20. Referring to FIG. 21, the reflection loss may be less than about 10 dB at a frequency band of about 2.29 GHz to about 2.50 GHz, and it is possible to achieve a 10 dB bandwidth of about 8.9%. Also, FIG. 22 is a diagram illustrating a radiation pattern of the antenna of FIG. 20 at about 2.38 GHz. Cross-polarization may be less than about −11 dB.

The following Table 2 shows operational characteristics of the ZOR antennas according to embodiments 1 to 3.

TABLE 2

| | Embodiment 1 (Asymmetric) | Embodiment 2 (Symmetric) | Embodiment 3 |
|---|---|---|---|
| Resonant Frequency (GHz) | 1.5 | 2.03 | 2.38 |

TABLE 2-continued

| | Embodiment 1 (Asymmetric) | Embodiment 2 (Symmetric) | Embodiment 3 |
|---|---|---|---|
| Electrical Size ($\lambda_0$) | 0.072 × 0.04 × 0.008 | 0.097 × 0.053 × 0.011 | 0.128 × 0.07 × 0.012 |
| Bandwidth (%) | 4.8 | 6.8 | 8.9 |
| Gain (dBi) | −2.15 | 1.35 | 1.54 |
| Efficiency (%) | 42.5 | 62 | 77.8 |

Referring to Table 2, the physical sizes of the antennas according to the embodiments 1 to 3 may be identical to each other except an inductor unit. That is, $L_R$, $C_L$, and $C_R$ values of these antennas may be maintained identical, but only $L_L$ value may vary.

Since the antenna according to the embodiment 1 has unit cells 135 of an asymmetrical shape, the antenna may be configured by removing the meander line 220 connected to one side of each unit cell 135 from the antenna having unit cells 135 of a symmetrical shape according to the embodiment 2. Since the $L_L$ value of the embodiment 1 is greater than the $L_L$ value of the embodiment 2, the resonant frequency of the embodiment 1 may be reduced from about 2.03 GHz to about 1.5 GHz. Therefore, the electrical size of the antenna of the embodiment 1 may become smaller than that of the embodiment 2. On the other hand, the radiation efficiency may be reduced due to the size of an electrically small aperture of the antenna of the embodiment 1. It can be verified in Table 2 that the radiation efficiencies of the antennas according to the embodiments 1 and 2 are about 62% and about 42.5%, respectively. Also, the maximum gains of the antennas according to the embodiments 1 and 2 are about 1.35 dBi and about −2.15 dBi, respectively.

Figure 1:
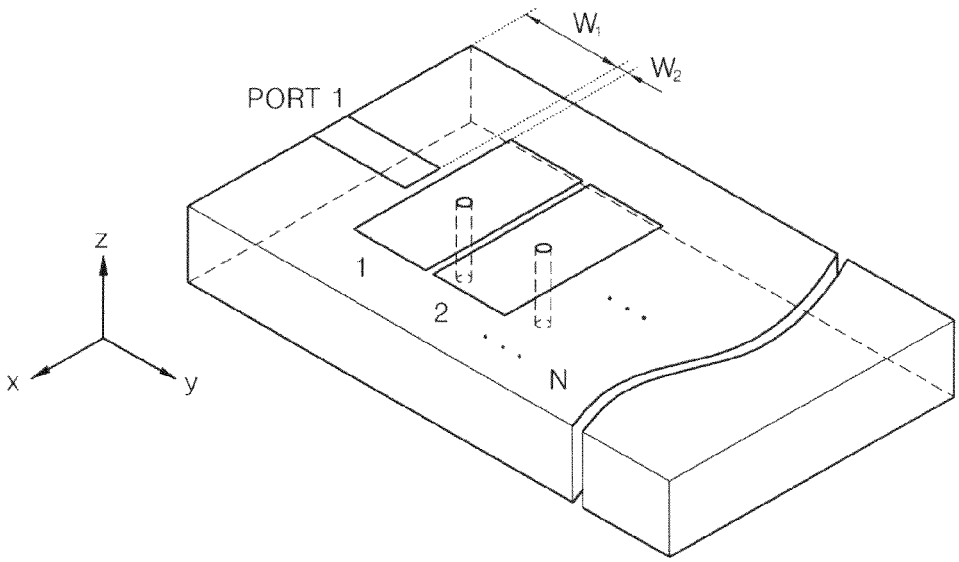
FIG. 1 is a diagram illustrating a related-art zeroth-order resonant (ZOR) antenna.
Figure 2:
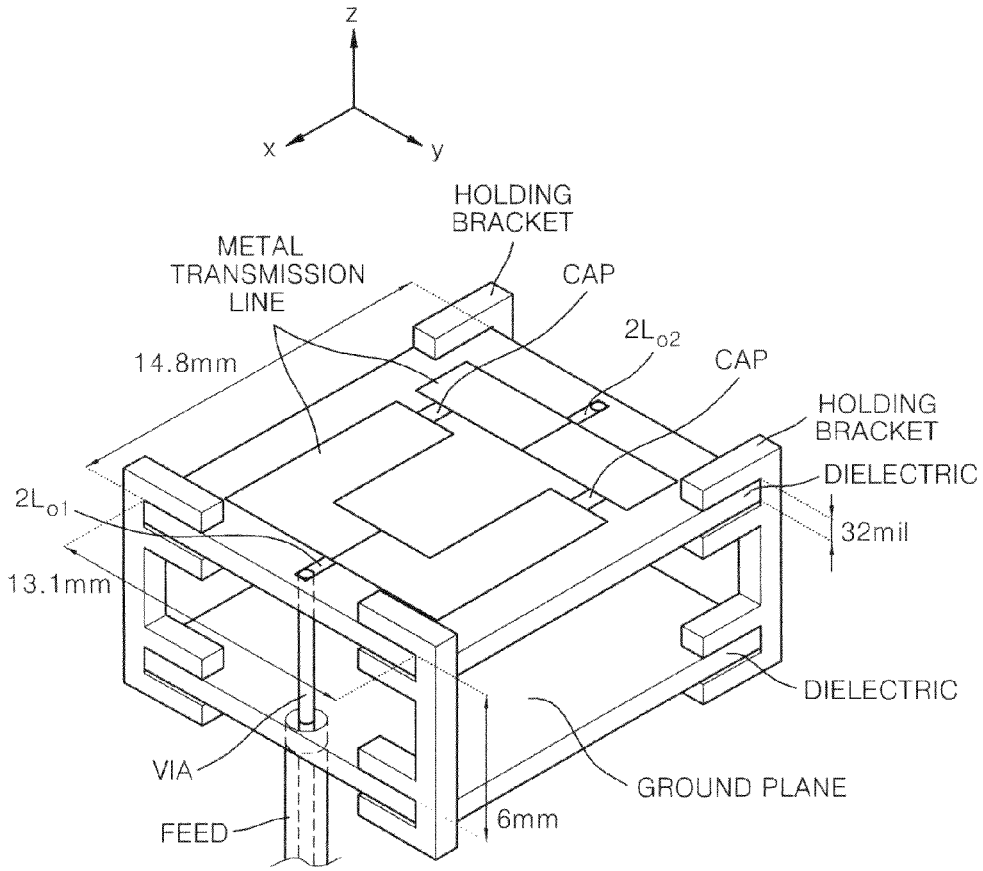
FIG. 2 is a diagram illustrating a configuration of a metamaterial ring antenna proposed for bandwidth improvement.
Figure 3:
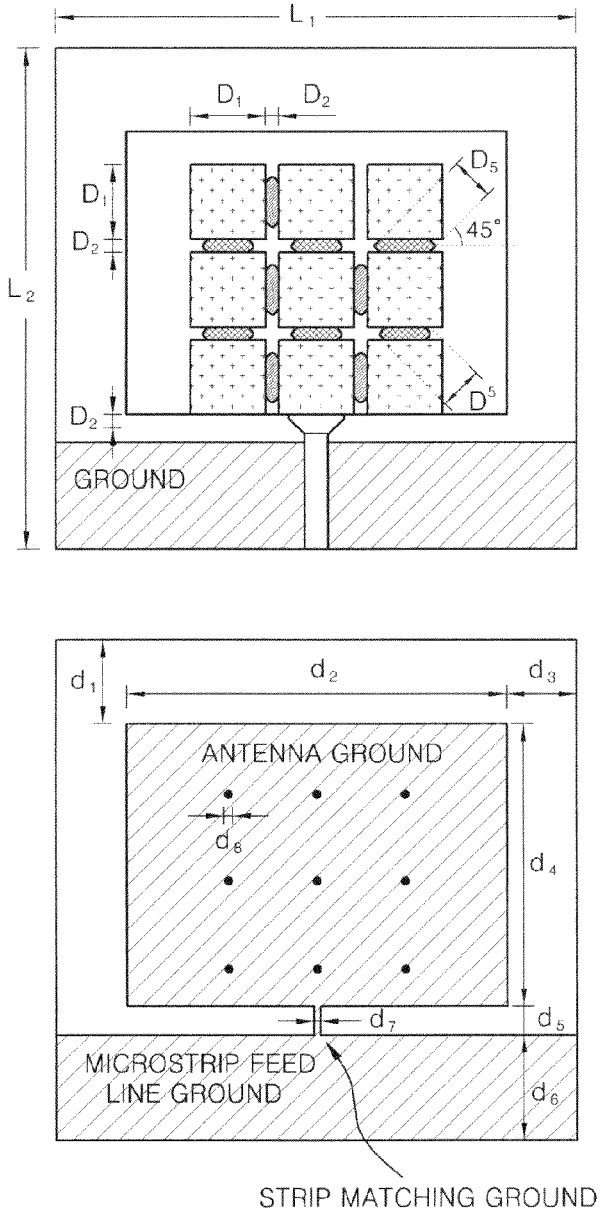
FIG. 3 is a diagram illustrating a structure of another small-size antenna with extended bandwidth.

The antenna according to the embodiment 3 may be designed by substituting the meander line 220 of the antenna of the embodiment 2 with the chip inductor 710. Since the chip inductance is easily adjusted, the antenna of the embodiment 3 may be easily implemented to have a desired resonant frequency. As shown in FIG. 2, the radiation efficiency of the antenna of the embodiment 3 may be about 77.8% at about 2.38 GHz, and the maximum gain may be about 1.54 dBi.

The antennas according to the embodiments 1 to 3 may provide extended bandwidths of about 5%, about 6.8%, and about 8.9%, respectively. The antenna according to the embodiment 1 may have a larger $L_L$ value while having a narrower bandwidth. This is because the balance of $Y'_{shunt}$ has not been achieved, and the G value has been reduced.

Figure 23:
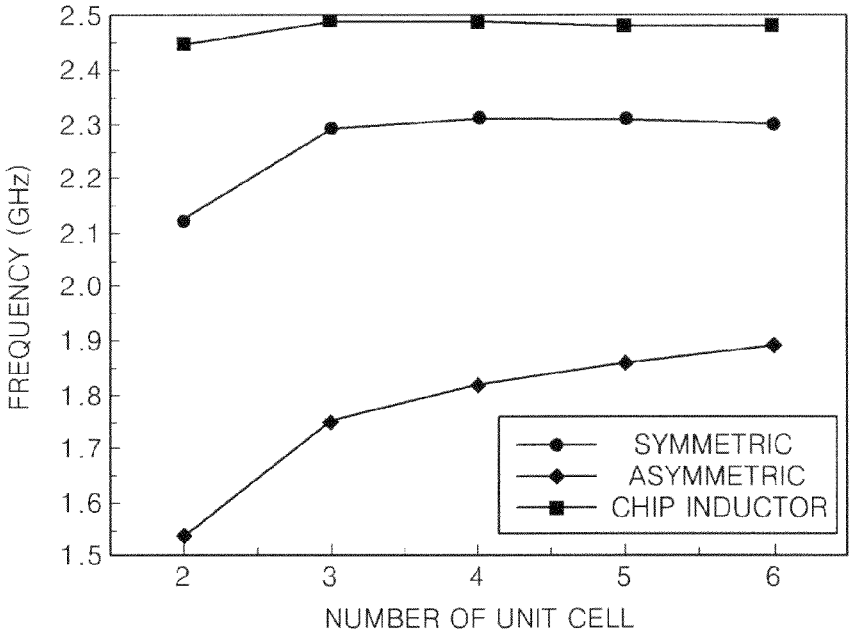
FIG. 23 is a graph illustrating frequencies according to the number of unit cells.

As described above, the resonance condition at the ZOR frequency has no relation with the size of an aperture. FIG. 23 is a graph illustrating frequencies according to the number of unit cells. Although the number of the unit cells increases and the size of the aperture increases, the resonant frequency may be maintained constant. On the other hand, as the size of the resonant antenna increases, the resonant frequency of a related-art resonant antenna may be reduced.

Referring to the radiation pattern of the antennas according to the embodiments described above, the level of the cross polarization was higher in the actual measurement result than in the simulation result. A difference between the simulation and actual measurement results may be caused by a measurement error and a limitation in manufacturing a meander line having high purity.

According to a small zeroth-order resonant antenna that has extended bandwidth and high efficiency and be implemented by a simple process, a ground via is not required by disposing all of a feeding patch, a transmission line, and a ground patch on the same plane of a substrate using a CPW structure. Also, since a substrate having a mono-layer structure is used, its structure is simple and its implementation is relatively easy. Also, the manufacturing process can be simplified by determining a value of a parameter affecting a resonant frequency by adjustment of an inductance value and arrangement of each part other than determining the operation characteristics of the antenna using the characteristics of the substrate. Furthermore, the bandwidth can be improved by maintaining a broad space between an upper patch and the ground patch to minimize a capacitance and maximize an inductance.

Although the simply fabricable small zeroth-order resonant antenna with extended bandwidth and high efficiency has been described with reference to the specific embodiments, it is not limited thereto. Therefore, it will be readily understood by those skilled in the art that various modifications and changes can be made thereto without departing from the spirit and scope of the present invention defined by the appended claims.

What is claimed is:

1. A zeroth-order resonant antenna comprising:

a feeding patch disposed on a top surface of a substrate having a mono-layer structure and configured to receive a signal from the outside;

a transmission line comprising a unit cell disposed on the top surface of the substrate and configured to transmit a signal delivered from the feeding patch; and a pair of ground patches longitudinally disposed on the top surface of the substrate in the same direction as a longitudinal direction of the transmission line around the transmission line, wherein the unit cell comprises:

an upper patch disposed on the top surface of the substrate and configured to receive a signal; and an inductor unit disposed on the top surface of the substrate to connect between the upper patch and the ground patch and configured to have an adjustable inductance value.

2. The zeroth-order resonant antenna of claim 1, wherein the transmission line comprises a plurality of unit cells that are consecutively disposed.

3. The zeroth-order resonant antenna of claim 2, wherein the inductor unit connects the ground patch to one side of the rectangular upper patch, the one side being parallel to a longitudinal direction of the ground patch.

4. The zeroth-order resonant antenna of claim 3, wherein the one side to which the inductor unit is connected is opposite to a side of another upper patch to which another inductor unit is connected in an adjacent unit cell.

5. The zeroth-order resonant antenna of claim 2, wherein the inductor unit is formed in pair to connect the ground patches to two sides of the upper patch parallel to a longitudinal direction of the ground patch, respectively.

6. The zeroth-order resonant antenna of claim 1, wherein the inductor unit is a meander line.

7. The zeroth-order resonant antenna of claim 2, wherein the inductor unit is a meander line.

8. The zeroth-order resonant antenna of claim 3, wherein the inductor unit is a meander line.

9. The zeroth-order resonant antenna of claim 4, wherein the inductor unit is a meander line.

10. The zeroth-order resonant antenna of claim 6, wherein the length of the meander line is configured to correspond to an inductance value for achieving a predetermined resonant frequency.

11. The zero-order resonant antenna of claim 1, wherein the inductor unit comprises a chip inductor.

12. The zero-order resonant antenna of claim 2, wherein the inductor unit comprises a chip inductor.

13. The zero-order resonant antenna of claim 3, wherein the inductor unit comprises a chip inductor.

14. The zero-order resonant antenna of claim 1, further comprising an output patch disposed on the top surface of the substrate and configured to output the signal delivered through the transmission line to the outside.

15. The zero-order resonant antenna of claim 2, further comprising an output patch disposed on the top surface of the substrate and configured to output the signal delivered through the transmission line to the outside.

16. The zero-order resonant antenna of claim 3, further comprising an output patch disposed on the top surface of the substrate and configured to output the signal delivered through the transmission line to the outside.

17. The zero-order resonant antenna of claim 14, wherein the pair of ground patches are longitudinally formed around the feeding patch, the transmission line and the output patch.

18. The zero-order resonant antenna of claim 1, further comprising a lower patch having a rectangular shape and disposed on an undersurface of the substrate.

19. The zero-order resonant antenna of claim 2, further comprising a lower patch having a rectangular shape and disposed on an undersurface of the substrate.

20. The zero-order resonant antenna of claim 3, further comprising a lower patch having a rectangular shape and disposed on an undersurface of the substrate.

* * * * *